United States Patent [19]

Bass

[11] Patent Number: 4,926,509

[45] Date of Patent: May 22, 1990

[54] BIDET

[76] Inventor: Joyce H. Bass, 2405 Arbor Oaks Dr., Arlington, Tex. 76006

[21] Appl. No.: 222,132

[22] Filed: Jul. 21, 1988

[51] Int. Cl.[5] ..... A61H 35/00

[52] U.S. Cl. ..... 4/448; 4/420.4

[58] Field of Search ..... 4/420.1, 420.2, 420.4, 4/420.5, 443, 444, 447, 448

[56] References Cited

U.S. PATENT DOCUMENTS

| | | | |
|---|---|---|---|
| 1,091,499 | 3/1914 | Friedman | 4/420.5 |
| 1,521,892 | 1/1925 | Koppin | 4/420.4 |
| 1,663,111 | 3/1928 | Campus | 4/420.5 |
| 1,855,008 | 4/1932 | Callejo | 4/420.5 |
| 1,872,278 | 8/1932 | Guidetti et al. | 4/420.5 |
| 1,966,951 | 7/1934 | Guidetti | 4/420.5 |
| 2,852,782 | 9/1958 | Sundberg | 4/420.4 |
| 3,430,267 | 3/1969 | Van Houten | 4/420.4 |
| 4,069,519 | 1/1978 | Alexander | 4/447 |
| 4,181,985 | 1/1980 | Rius | 4/448 |
| 4,334,329 | 7/1982 | Miyanaga | 4/443 |
| 4,391,004 | 7/1983 | Kawai et al. | 4/420.4 |
| 4,451,942 | 6/1984 | Hirano et al. | 4/420.4 |
| 4,642,820 | 2/1987 | Boring, Jr. | 4/420.4 |

*Primary Examiner*—Henry J. Recla
*Assistant Examiner*—J. Casimer Jacyna
*Attorney, Agent, or Firm*—Hubbard, Thurman, Turner, Tucker & Harris

[57] ABSTRACT

Disclosed is a bidet apparatus. The apparatus includes a spray pipe pivotally mounted to a toilet. The spray pipe is movable between a retracted position and an in-use position. A spray nozzle is connected to the spray pipe. A crank arm extending outwardly of the spray pipe is positioned to pivot the spray pipe between the retracted and the extended positions. A valve having at least one inlet and a single outlet is mounted to the toilet. The valve is operated between a valve open position and a valve closed position by a single lever handle. A conduit is connected between the outlet of the valve and the spray pipe and a link is connected between the lever handle and the crank arm such that movement of the lever handle to the valve open position pivots the spray pipe to the in-use position.

21 Claims, 1 Drawing Sheet

BIDET

BACKGROUND OF THE INVENTION

1. Field of the Invention

This invention relates generally to a personal hygiene apparatus and more particularly to a bidet apparatus that may be fitted to or made a part of a conventional bathroom toilet.

2. Description of the Prior Art

Bidets have long been used in Europe as a device for cleaning a person's posterior or genital areas by flushing them with a spray of water. Such bidets are typically unitary structures having only one purpose and they are provided in bathrooms in addition to a conventional toilet. Bidets have found application in the United States primarily only in some hospitals and some luxury hotels. However, bidets have not become commonplace in the typical United States home.

The benefits to be derived by people, including both males and females, by the use of a bidet are manifold. Immediate recognition of benefits will be appreciated by persons suffering from painful hemorhoids, constipation, or diarrhea, and by post-surgery patients, post-childbirth patients and nursing home patients. Additionally, people without any of the foregoing conditions or disabilities can enjoy the benefits of increased cleanliness and improved hygiene by daily use of a bidet.

The primary obstacle in the way of the use of bidets becoming commonplace in the U.S. is the expense involved in the installation of a separate bidet in a bathroom. The bidet itself is expensive and, more importantly, bathrooms tend to be small and there is usually insufficient space in which to install a separate bidet.

There have been proposals for incorporating a bidet fixture in a preexisting toilet. Such apparatus typically include a spray pipe that is movable from a retracted, out of the way, position to an in-use position, and a valve for controlling the flow of water to the spray pipe. Examples of such devices are disclosed in the following patents:

| Inventor | U.S. Pat. No. |
|---|---|
| Boring, Jr. | 4,642,820 |
| Miyanaga | 4,334,329 |
| Ruiz | 4,181,985 |
| Sundberg | 2,852,782 |
| Guidetti | 1,966,951 |
| Guidetti, et al. | 1,872,278 |
| Callejo | 1,855,008 |
| Campus | 1,663,111 |
| Friedman | 1,091,499 |

SUMMARY OF THE INVENTION

The bidet apparatus of the present invention includes a spray pipe that is pivotally mounted or mounted to a toilet. The spray pipe is movable between a retracted position and an in-use position. A spray nozzle is connected to the spray pipe. A crank arm is also connected to the spray pipe and it is positioned to pivot the spray pipe between the retracted and the extended positions.

A valve is mounted or mountable to the toilet. The valve has at least one inlet, and preferable two inlets—one for hot water and the other for cold water—and a single outlet. The valve is operable between a valve open position and a valve closed position by a single lever handle. A conduit connects the outlet of the valve to the spray pipe. A link connects the lever handle of the valve to the crank arm of the spray pipe. Thus, when the water is turned on by movement of the lever handle, the spray pipe is pivoted to the in-use position. Conversely, when the water is turned off, the spray pipe is pivoted back to the retracted position.

The bidet apparatus of the present invention may include an anti-siphon vacuum breaker valve positioned in the conduit so as to prevent contaminated water from entering the domestic water supply. The apparatus may also include a by-pass valve for supplying hot water directly to the conduit. Such a by-pass valve is useful to clear cold water from the hot water line prior to using the bidet apparatus. The device may include a spray shield that deflects water sprayed from the nozzle when the spray pipe is in the retracted position. The device may also include means for adjusting the position of the spray pipe independent of the movement of the lever handle so that the spray can be directed more accurately.

DESCRIPTION OF THE PREFERRED EMBODIMENT

Figure 1:
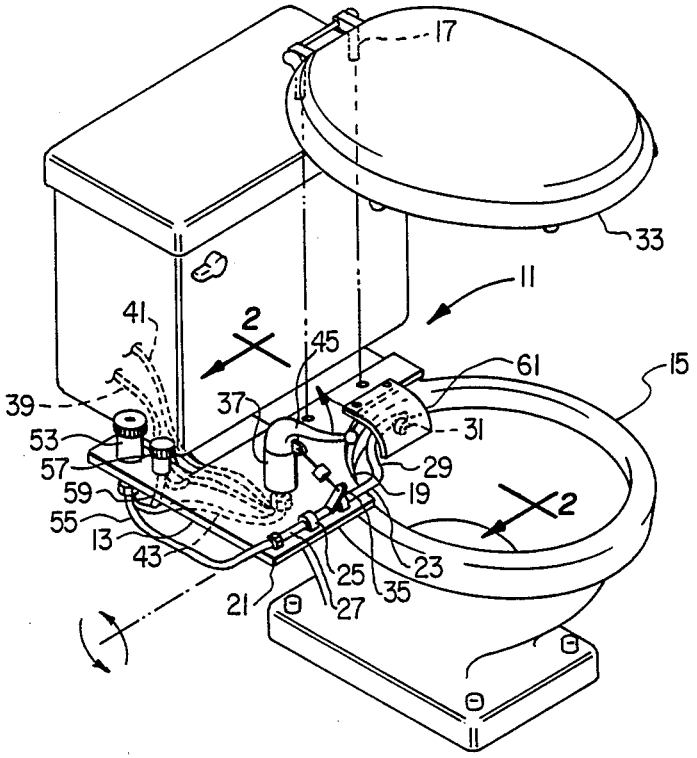
FIG. 1 is a perspective view of the bidet apparatus of the present invention fitted on a conventional home toilet.

Referring to the drawing, the bidet apparatus of the present invention is designated generally by the numeral 11. In the preferred embodiment, bidet apparatus 11 includes a flat base plate 13 that is mounted to a toilet 15 by toilet seat bolts 17. It will be recognized that while in the preferred form of the invention, bidet apparatus 11 is a separate attachment that may be mounted on or removed from a preexisting toilet, a bidet apparatus in accordance with the teachings of the invention could be incorporated into a unitary toilet structure.

Base plate 13 includes an arcuate portion 19 that conforms to the perimeter of the toilet bowl. Base plate 13 also includes an extended portion 21 that extends outwardly of the toilet bowl structure and upon which various elements of bidet apparatus 11 are mounted.

Bidet apparatus 11 includes a spray pipe 23 that is pivotally mounted to extended portion 21 of base plate 13 by means of bearings 25. Spray pipe 23 includes a straight portion 27 that is supported by spaced apart bearings 25 and a curved portion 29 that conforms generally to the curvature of the toilet bowl. Spray pipe 23 includes a spray nozzle 31 positioned near the end of curved portion 29.

Figure 2:
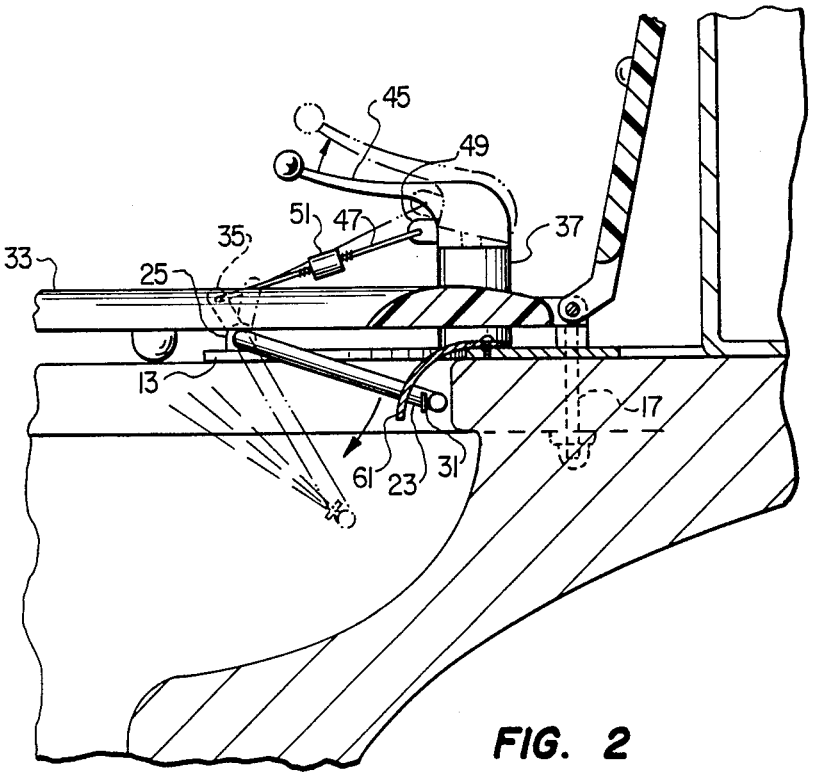
FIG. 2 is a sectional view taken generally along line 2—2 of FIG. 1 showing details of the bidet apparatus of the present invention.

Spray pipe 23 is movable between a retracted position, as shown in the drawing figures and in in-use position, as shown in phantom in FIG. 2. In the retracted position, curved portion 29 of spray pipe 23 is generally concealed by toilet seat 33 and, thus, it is out of the way. In the in-use position, nozzle 31 is positioned to direct a spray of water at the genital or posterior areas of the user. As will be described in greater detail below, spray pipe 23 is movable between the retracted and in-use positions by means of a crank arm 35 connected to and extending outwardly of straight portion 27 of spray pipe 23. In the preferred embodiment, crank arm 35 is positioned between bearings 25.

Bidet apparatus 11 includes a valve 37 mounted to extended portion 21 of base plate 13. Valve 37 is a single-handled mixing valve of the type disclosed in U.S. Pat. No. 3,056,418, and it includes inlets connected to a hot water line 39 and a cold water line 41. Valve 37 has a single outlet that is connected to a conduit 43. Conduit 43 and water lines 39 and 41 are preferably copper tubing; however, those skilled in the art will recognize other materials that may be suitably used.

Valve 37 is operated between a valve closed position and a valve open position by means of a single lever handle 45. The force of water emerging from valve 37 is controlled by moving handle 45 in the vertical plane. The temperature of the water is controlled by moving lever handle 45 in the horizontal plane. Thus, both water force and temperature are controlled simply by the position of lever handle 45.

Lever handle 45 is connected to crank arm 35 by means of a link 47. Link 47 is a bar pivotally connected to both crank arm 35 and a tab 49 connected to lever handle 45. As is best shown in FIG. 2, movement of lever handle 45 to the valve open position is transmitted through link 47 to crank arm 35, which moves spray pipe 23 to the in-use position. Side to side motion of lever arm 45 in controlling the water temperature does not significantly affect the position of spray pipe 23.

As indicated in FIG. 2, spray pipe 23 moves along an arc when moving between its in use position and the retracted position. Since spray pipe 23 moves arcuately rather than linearly, nozzle 31 moves along an arc about a horizontal axis defined by straight portion 27 supported by bearings 25. With spray pipe 23 pivotable about the horizontal axis as shown, the spray emitted from nozzle 31 once valve 37 reaches its open position is generally directed at the same area of the user's posterior throughout the range of motion defining the in use position. This feature enables the user to adjust the force of the spray by moving lever handle 45 vertically without significantly altering the area being washed. Therefore, the user of bidet apparatus 11 is able to adjust both the temperature and force of the washing spray while maintaining the direction of the spray towards the desired areas of the user's posterior.

In order to enable the user to control more accurately the position of spray nozzle 31 during use, link 47 may include a nut 51 that is threadedly positioned in link 47. The bar of link 47 is divided into two parts, the ends of which are threaded in opposite directions and engaged with nut 51. Thus, rotation of nut 51 in one direction effectively lengthens link 47 whereas rotation in the other direction effectively shortens link 47.

Bidet apparatus 11 includes an anti-siphon vacuum breaker valve 53 mounted to extended portion 21 of base plate 13 and forming part of the flow path of conduit 43. Anti-siphon vacuum breaker valve 53 is included for reasons of public health and it prevents contaminated water from being siphoned back through spray pipe 23 into the domestic water supply. In the preferred embodiment, anti-siphon vacuum breaker valve 53 is a WATTS Model 388A.

The downstream end of conduit 43 is defined by a flexible tube 55 that connects anti-siphon vacuum breaker valve 53 with straight portion 27 of spray pipe 23. The flexible tube is preferred in that it provides a simple means of accommodating the pivoting of spray pipe 23.

Bidet apparatus 11 may include means for bypassing hot water around valve 37. The preferred means is a valve 57 that is mounted to extended portion 21 of base plate 13. Valve 57 is positioned in a conduit 59 that connects hot water line 39 and conduit 43. By opening valve 57, water from hot water line 39 is allowed to flow directly to conduit 43 and out nozzle 31, thereby clearing hot water line 39 of accumulated cold water. When the cold water is cleared, then valve 37 may be opened in the usual manner to provide a spray of warm water. A spray shield may be removably attached by screws or the like to base plate 13 to deflect water sprayed from nozzle 31 when spray pipe 23 is in the retracted position. As is best shown in FIG. 2, spray shield 61 has an arcuate cross-section and it is effectively concealed beneath toilet seat 33.

It may thus be seen that bidet apparatus 11 of the present invention provides a simple and effective device by which a normal toilet may be converted into a bidet. It is contemplated that device 11 would be hooked up to the normal hot and cold water outlets that are available in a bathroom. If no hot water line is available, then a small capacity water heated can be installed in the vicinity of the toilet. It would be desirable for the heater to have a thermostat to keep the water temperature from exceeding about 102.6° F. Also, in the situation where hot water is available in the bathroom, a tempering valve might be employed to select a temperature not to exceed 102.6° F. for the hot water supply.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the size, shape and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A bidet apparatus adapted to be fitted to a toilet including a bowl having an upper horizontal rim surface, which comprises:

a base plate attachable to said upper horizontal rim surface;

a spray pipe pivotally mounted to said base plate about a horizontal axis, said spray pipe having an inlet and an outlet and sized and shaped to be movable between a retracted position adjacent said rim surface and an in use position extending toward the center of said bowl;

a spray nozzle connected to the outlet end of said spray pipe;

a crank arm connected to said spray pipe to pivot said spray pipe about said horizontal axis between said retracted and in use positions;

a valve mounted to said base plate adjacent to and horizontally displaced from said crank arm, said valve having an outlet and at least one inlet, said valve having a lever handle pivotable about a horizontal axis between a valve open position and a valve closed position by said lever handle, said valve being operative to selectively control the rate of flow of water passing through the bidet apparatus, said rate of flow being selectable in response to linear movement of said lever handle;

conduit means for connecting said outlet of said valve to said spray pipe;

and a link pivotally connected between said lever handle of said valve and said crank arm, whereby movement of said lever handle to said valve open position pivots said spray pipe to said in use position; wherein said spray pipe is curved such that movement of said lever handle to change the rate of flow does not appreciably change the direction of the spray exiting said spray nozzle while said spray nozzle is in said in use position.

2. The bidet apparatus as claimed in claim 1, wherein: said link is external of said conduit means.

3. The bidet apparatus as claimed in claim 1, wherein said conduit means includes a flexible hose connected to said spray pipe.

4. The bidet apparatus as claimed in claim 1, including an anti-siphon vacuum breaker valve positioned in said conduit means.

5. The bidet apparatus as claimed in claim 1, wherein said valve includes hot and cold water inlets and said lever handle controls the flow of both hot and cold water to said outlet.

6. The bidet apparatus as claimed in claim 5, including auxilliary valve means for connecting hot water to said conduit and bypassing said valve.

7. The bidet apparatus as claimed in claim 6, including a spray shield connected to said base plate and positioned to deflect water from said nozzle when said pipe is in said retracted position.

8. The bidet apparatus as claimed in claim 7, wherein said spray shield is detachable from said base plate.

9. The bidet apparatus as claimed in claim 1, including means adjusting the position of said spray pipe independent of the movement of said lever handle.

10. The bidet apparatus as claimed in claim 9, wherein said means for adjusting the position of said spray pipe includes means for changing the length of said link.

11. The bidet apparatus as claimed in claim 10, wherein said means for changing the length of said link includes a nut threadedly positioned in said link.

12. A bidet apparatus adapted to be fitted to a toilet including a bowl having an upper horizontal rim surface, which comprises:

a base plate attachable to said upper horizontal rim surface;

a spray pipe pivotally mounted to said base plate about a horizontal axis, said spray pipe having an inlet and an outlet and sized and shaped to be movable between a retracted position adjacent said rim surface and an in use position extending toward the center of said bowl;

a spray nozzle connected the outlet end of to said spray pipe;

a crank arm extending outwardly of said spray pipe and positioned to pivot said spray pipe about said horizontal axis between said retracted and extended positions;

a valve mounted to said base plate adjacent to and horizontally displaced from said crank arm, said valve having a hot water inlet and a cold water inlet and a single outlet, said valve having a lever handle pivotable about a horizontal axis between a valve open position and a valve closed position by said lever handle, said valve being operative to selectively control the rate of flow of water passing through the bidet apparatus, said rate of flow being selectable in response to linear movement of said lever handle;

conduit means for connecting said outlet of said valve to said spray pipe;

and a link pivotally connected between said lever handle of said valve and said crank arm, whereby movement of said lever handle to said valve open position pivots said spray pipe to said in use position, said link being external of said conduit means; wherein said spray pipe is curved such that movement of said lever handle to change the rate of flow does not appreciably change the direction of the spray exiting said spray nozzle while said spray nozzle is in said in use position.

13. The bidet apparatus as claimed in claim 12, wherein said spray pipe and said valve are mounted to a base plate mounted to said toilet.

14. The bidet apparatus as claimed in claim 12, including an anti-siphon vacuum breaker valve positioned in said conduit means.

15. The bidet apparatus as claimed in claim 12, including means for supplying hot water to said conduit means bypassing said valve.

16. The bidet apparatus as claimed in claim 15, including a spray shield positioned to deflect water from said nozzle when said spray pipe is in said retracted position.

17. The bidet apparatus as claimed in claim 16, wherein said spray shield is removably mounted with respect to said toilet.

18. The bidet apparatus as claimed in claim 12, including means for adjusting the position of said spray pipe independent of the movement of the said lever handle.

19. The bidet apparatus as claimed in claim 18, wherein said means for adjusting the position of said spray pipe includes means for changing the length of said link.

20. The bidet apparatus as claimed in claim 19, wherein said means for changing the length of said link includes a nut threadedly positioned in said link.

21. The bidet apparatus as claimed in claim 12, wherein said valve is operative to selectively adjust the mixture of hot and cold water provided through said hot and cold water inlets, respectively, said adjustment being effected by movement of said lever handle.

* * * * *